US005292071A

United States Patent [19]

Kruer

[11] Patent Number: 5,292,071

[45] Date of Patent: Mar. 8, 1994

[54] IN-GROUND PULL-UP SPRINKLER WITH ABOVE GROUND HOSE CONNECTION

[75] Inventor: Thomas R. Kruer, Edgewood, Ky.

[73] Assignee: L. R. Nelson Corporation, Peoria, Ill.

[21] Appl. No.: 77,632

[22] Filed: Jun. 17, 1993

[51] Int. Cl.[5] ..... B05B 3/04

[52] U.S. Cl. ..... 239/242; 239/240; 239/276

[58] Field of Search ..... 239/237, 240–242, 239/276, 200–206

[56] References Cited

U.S. PATENT DOCUMENTS

| | | | |
|---|---|---|---|
| 2,573,786 | 11/1951 | Brodbeck et al. | 239/204 |
| 2,668,078 | 2/1954 | Snoddy | 239/204 |
| 2,757,045 | 7/1956 | Nullet | 239/204 |
| 2,983,451 | 5/1961 | Ramsey | 239/276 |
| 3,387,785 | 6/1968 | Jaggers | 239/200 |
| 3,929,288 | 12/1975 | Brusadin et al. | 239/201 |
| 4,353,506 | 10/1982 | Hayes | 239/206 |
| 4,856,823 | 8/1989 | Heren | 285/81 |
| 4,858,827 | 8/1989 | Fletcher et al. | 239/69 |
| 4,892,252 | 1/1990 | Bruninga | 239/205 |
| 5,050,801 | 9/1991 | Ferrari | 239/276 |

*Primary Examiner*—Karen B. Merritt

*Attorney, Agent, or Firm*—Cushman, Darby & Cushman

[57] ABSTRACT

The lawn sprinkler device comprises a manually operative combination of a container, sprinkler head and lid components. The container and lid are manually movable between a closed position defining a closed volume in the container and an open position that provides access to the closed volume. The container and lid are mounted within the ground so that the closed volume extends downwardly from the level of the lawn area and in the open position access to the closed volume is available generally at the level of the lawn area. The sprinkler head component includes a hose coupling inlet for manual connection by a user with an above-ground hose and an outlet structure for discharging water under pressure in a desired pattern on the lawn area. The sprinkler head is mounted with respect to the container and lid for manual movement between a storage position within the closed volume of the container and an operative position which is in elevated relation to the closed volume. In the operative position the sprinkler head can be manually connected to the above-ground hose containing a source of water under pressure so that water will discharge from the outlet in a desired pattern on the lawn area.

20 Claims, 5 Drawing Sheets

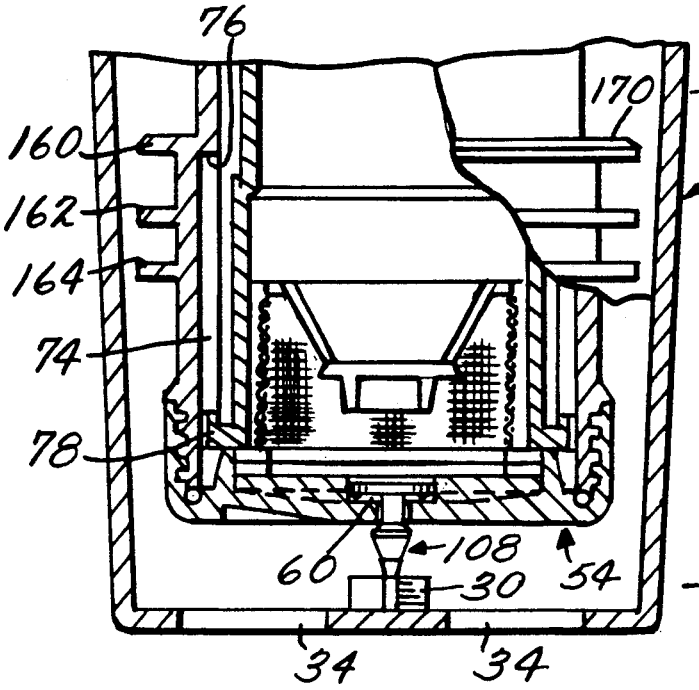
Fig. 18.
Fig. 20.
Fig. 19.
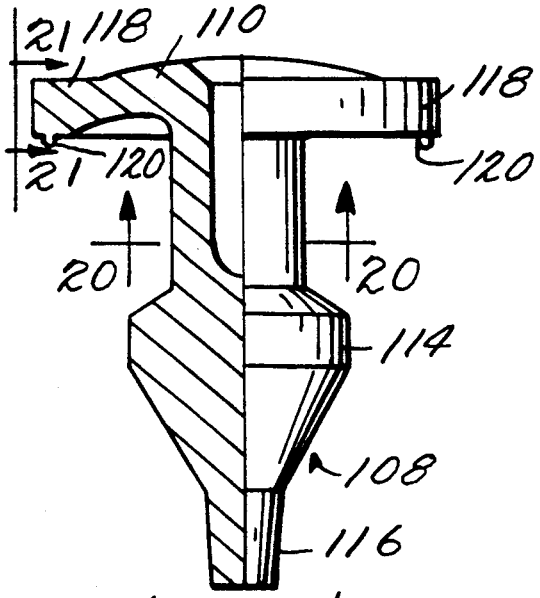
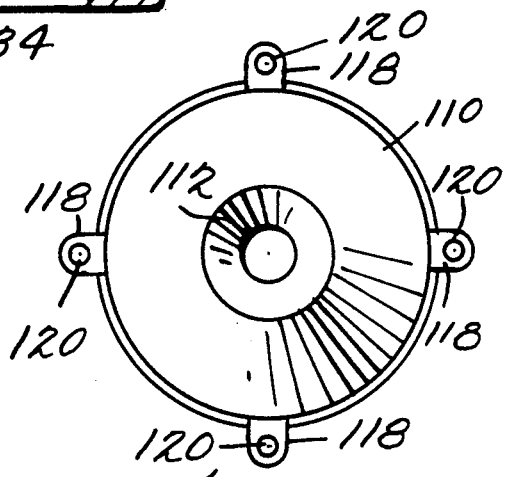
Fig. 22.
Fig. 21.
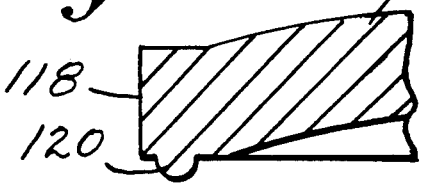
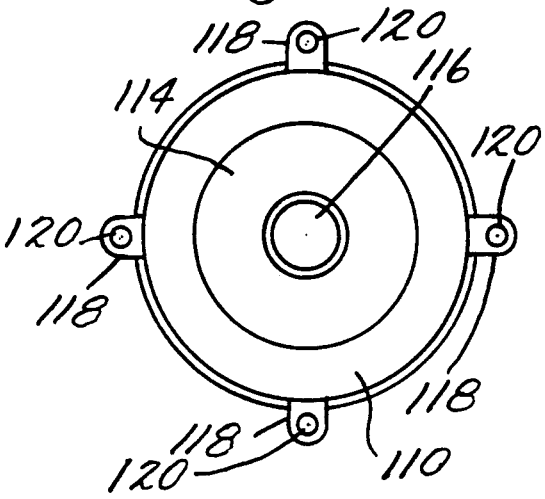

IN-GROUND PULL-UP SPRINKLER WITH ABOVE GROUND HOSE CONNECTION

This invention relates to lawn sprinkler systems and more particularly to a sprinkler device for in-ground installation operable to be connected with an above ground hose.

BACKGROUND OF THE INVENTION

There are two basic types of lawn sprinkler systems on the market. The first type of system uses above-ground hoses that are attached to a water supply and to a portable sprinkler. This system allows the user to freely place the sprinkler in any position on the lawn. To entirely water a lawn area, a user must move the hose and sprinkler to different locations. This free moving system offers the user a number of advantages. 1) The materials needed, i.e. a hose and a sprinkler, are readily available on the market, and 2) the variety of sprinklers available offer the user different options of expense and area coverage depending on the size and shape of the area to be covered. This system has disadvantages, it can be time consuming for the user as the system must be set up each time it is used and the hose and sprinkler must be moved and readjusted a number of times before an entire area is adequately watered. Furthermore, the act of watering the lawn can be messy as the user must walk through wet grass and readjust the sprinkler, with the risk of getting wet, each time it is moved.

The second type of system does not require the user to move hoses and sprinklers because the entire system is fixed underground. This fixed system has specially designed sprinklers that are installed in the ground. The sprinkler in the underground system is held in the ground by a canister when it is not in use. Underground pipes are connected to the canisters and a water supply. According to U.S. Pat. No. 4,892,252, when the water enters the canister, the pressure differential in the canister and sprinkler cause the sprinkler to pop-up out of the canister. After the sprinkler has popped-up, water will issue forth from the sprinkler outlet and water the area. When the water stops flowing through the system the sprinkler returns to its position within the canister by way of a spring or gravity. The sprinkler can also be of the type disclosed in U.S. Pat. No. 4,353,506 or an externally driven sprinkler.

Because the system is positionally fixed, it is simpler to operate and is far less time consuming. Often an underground system is attached to a timer that, on a regular basis, automatically will turn the water supply on and off. Consequently, the user is not required to spend the same amount of time to water the yard as in the first system and is not subject to the same sort of physical mess.

On the other hand, the underground system presents other problems for the user. Installation and maintenance is expensive as well as time consuming and disruptive. Because the system is installed in the ground, a system scheme must be specially designed for the area to be watered. Once a system is designed, the yard must be dug up to install the system. The yard also must be dug up to make any repairs to the sprinklers and the pipes. Furthermore, because the system is fixed, it is difficult to make modifications once it is installed. Much of this work is often performed by underground sprinkler system professionals instead of home owners or the like. In summary, the system can be difficult and expensive to maintain.

Because of the construction of the sprinkler and canister revealed in the prior art, it has not been possible to have a simple, inexpensive sprinkler system that can be retained below the ground when not in use.

As is evident from the above description, there are a number of limitations to the two prior art systems. The free moving system tends to be messy and time consuming, while the fixed system is expensive and difficult to install and repair. The difficulties suggested in the proceeding are not intended to be exhaustive but rather ones that tend to demonstrate some limitations of the two systems. Other noteworthy problems may also exist; however, the disadvantages presented above should be sufficient to illustrate that sprinkler systems known in the past will admit to worthwhile improvements.

BRIEF SUMMARY OF THE INVENTION

It is the object of the present invention to provide a sprinkler device capable of being incorporated in a sprinkling system which achieves in large measure the advantages of both of the prior art systems while eliminating in large measure the disadvantages thereof. In accordance with the principles of the present invention this object is achieved by providing a lawn sprinkler device for installation within the ground that discharges water in a desired pattern on a lawn area of the ground when manually connected by a user with an above-ground hose as a source of water under pressure. The device is comprised of a manually operative combination of container, sprinkler head and lid components.

The container and lid components are manually movable between a closed position, wherein a substantially closed volume is defined within said container and lid components, and an open position wherein access to said closed volume is available. The container and lid components are adapted so that they can be mounted within the ground of the lawn area to be sprinkled. The container and the lid are mounted in the ground so that (1) when the container and lid components are in their closed position the closed volume extends downwardly from the level of the lawn area, and (2) when the container and lid components are in their open position to access to the closed volume is available generally at the level of the lawn area.

The sprinkler head component includes a hose coupling inlet, for manual connection by a user with an above-ground hose containing a supply of water under pressure, and an outlet structure. The outlet structure discharges water under pressure in a desired pattern when an above-ground hose containing a source of water under pressure is manually connected with the hose coupling inlet. The sprinkler head component is mounted with respect to the container and the lid components for manual movement between a storage position and an operative position. In the storage position, the sprinkler head component is disposed within the closed volume with the container and lid components in their closed position. In the operative position, the sprinkler head component is in an accessed elevated relation to the closed volume with the container and lid components in their open position. The sprinkler head component being in the operative position enables the hose coupling inlet to be manually connected by a user with an above-ground hose containing a source of water under pressure so that water will be discharged from the outlet structure in the desired pattern on the lawn area.

All types of sprinkler heads can be used in this invention with an appropriately shaped container. Other objects and advantages of the present invention will become apparent from the following detailed description of a preferred embodiment of the invention taken in conjunction with the accompanying drawings.

BRIEF DESCRIPTION OF THE DRAWINGS

FIG. 18 is an enlarged fragmentary sectional view of sprinkler device taken along the line 18—18 of FIG. 1;

FIG. 19 is a front view of the rubber grommet showing the rubber grommet partially in sectional; and FIG. 20 is a sectional view taken along the line 20—20 of FIG. 19;

FIG. 21 is an enlarged fragmentary sectional view taken along the line 21—21 of FIG. 19; and FIG. 22 is a bottom view the rubber grommet.

DETAILED DESCRIPTION OF THE PRESENTLY PREFERRED EXEMPLARY EMBODIMENTS

Figure 2:
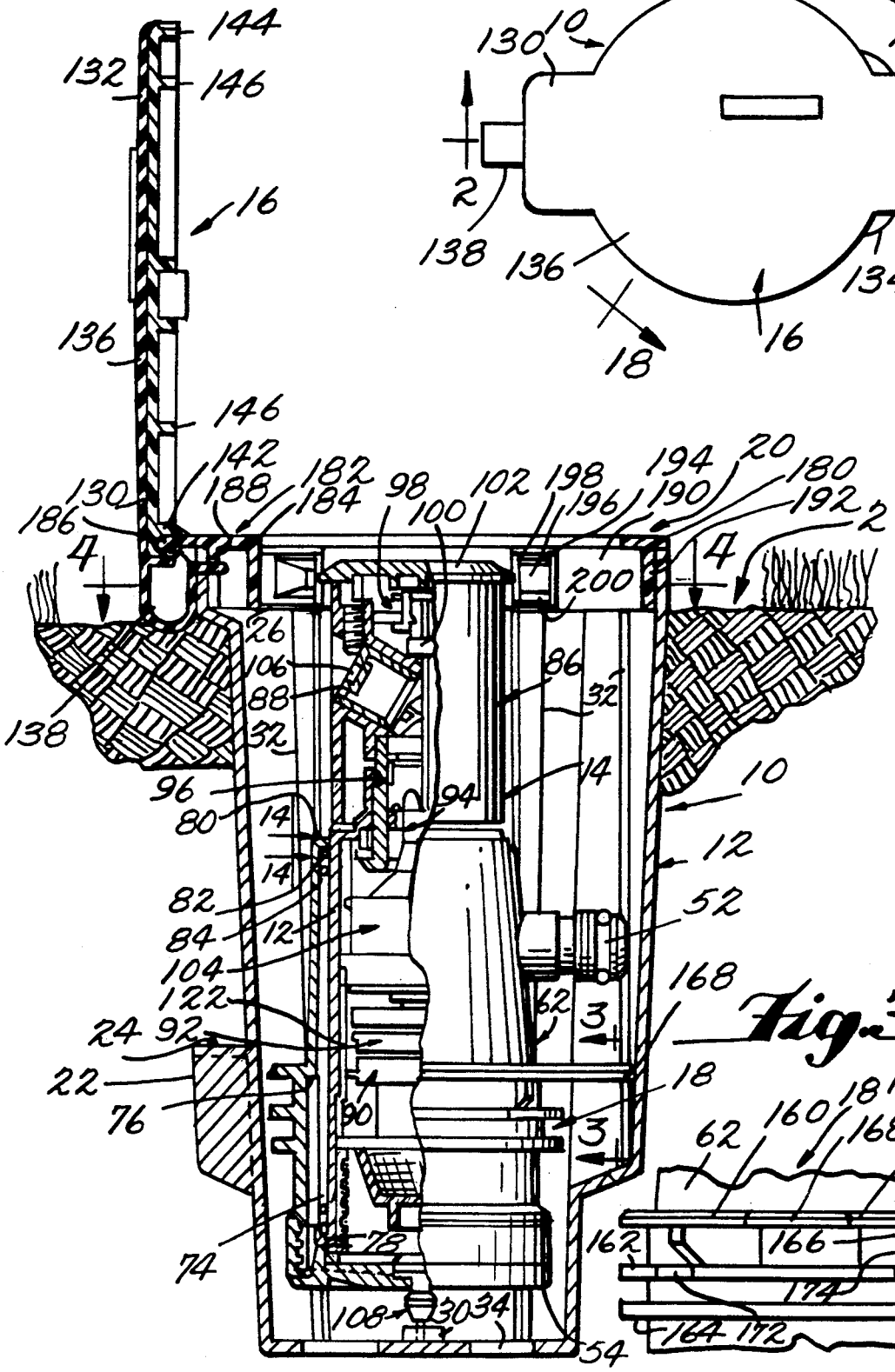
FIG. 2 is a sectional view of the in-ground sprinkler device taken along the line 2—2 of FIG. 1 but showing the lid in the open position and the sprinkler head component partially in sectional; in its stored position.

Referring now to the drawings, there is shown therein an in-ground sprinkler device generally indicated at 10, for use with an above ground hose or the like which embodies the principles of the present invention. The sprinkler device 10 comprises a manually operable combination of container, sprinkler head, and lid components. As shown in the drawings, the container component is designated generally by the reference numeral 12, the sprinkler head component is designated generally by the reference numeral 14 and the lid component is designated by the reference numeral 16.

The container and lid components 12 and 16 are manually movable between (1) a closed position wherein a substantially closed volume is defined within the container and lid components 12 and 16 and (2) an open position wherein access to the closed volume is available through an open top of the container.

The container and lid components 12 and 16 are adapted to be mounted within the ground 2 in a lawn area to be sprinkled so that (1) when the container and lid components 12 and 16 are in their closed position the closed volume extends downwardly from the level of the lawn area, and (2) when the container and lid components 12 and 16 are in said open position access to said closed volume is available generally at the level of said lawn area, The sprinkler head component 14 is mounted with respect to the container and lid components 12 and 16 for manual movement between (1) a storage position wherein the sprinkler head component 14 is disposed within the aforesaid closed volume with the container and lid components 12 and 16 disposed in the closed position and (2) an operative position wherein said sprinkler head component 14 is in accessed elevated relation to the closed volume with the container and lid components 12 and 16 in their open position enabling the sprinkler head component 14 be manually connected by a user with an above ground hose containing a source of water under pressure so that water will be discharged from sprinkler head component 14 in the desired pattern on the lawn area.

In the preferred embodiment of the device 10 to be hereinafter described in detail, the lid component 16 is connected with the container component 12 and is moved independently of the sprinkler head component 14. However, in its broadest aspects the invention contemplates embodiments in which the lid component 16 is connected with the sprinkler head component 14 and is moved independently of the container component 12. For example, the lid component 16 could be fixed to the operative bottom of the sprinkler head component 14 in a separate relationship from the container component 12. In the storage position, the sprinkler head component 14 would be suspended within the container component 12 by the lid component seated on the rim of the container component 12. In the operative position, the sprinkler head component 14 would be supported on the lid component 16 in a position thereabove with the lid component 16 supported on the rim of the container component 12 in inverted relation. Moreover, the lid component 16 may be interconnected with both the container 12 and sprinkler head 14 components by interconnecting the lid and sprinkler head components as before and pivoting the lid component 16 on the container component 12 so that the combination of components is the same in the storage position, but in the operative position the lid component 16 is pivoted into an inverted position on the same lawn area to support the sprinkler head component 14 thereabove.

It will be understood that the description of the sprinkler head component 14 as being mounted with respect to the container component 12 for manual movement between its storage and operative positions is not limited to a mode of operation where all movements in both directions are actually accomplished by a manual movement. Indeed, the preferred embodiment contemplates a movement which is effected manually in one direction by actually moving the sprinkler head component 14 while in the opposite direction the movement may only be initiated manually in that direction with the actual movement being effected by a mechanical bias. In the preferred embodiment shown and to be hereinafter described in detail, the actual movement from the storage position into the operative position is manual. Movement from the operative position into the storage position can be accomplished by gravitational bias after initially manually releasing the sprinkler head component 14 from its locked condition. Of course, where the manual movement of the sprinkler head component 14 out of its operative position is with a relatively high manual lock releasing force it can be said that the movement itself was accomplished by actual manual movement and assisted by gravitational movement.

The invention in its broadest aspects contemplates a mechanically biased movement of the sprinkler head 14 from its storage portion into its operative portion as by a spring (not shown) after a locking mechanism (not shown) which retains the sprinkler head component 14 in its storage position against the spring bias has been manually released. In other words, a mode of operation similar to a jack-in-the-box. Alternatively, an over center spring action could be utilized in which case partial mechanically biased movement would be accomplished in both directions after a partial accrual manual movement. A pivotal movement of the sprinkler head between a storage position supported by the container and an operative position supported on the adjacent ground in the manner previously indicated would constitute a gravitational bias equivalent of the over center spring action arrangement.

The sprinkler head component 14 can be of any type, including a simple one piece fixed pattern sprinkler head, a wave type sprinkler head, a rotary type sprinkler head, a step-by step rotary sprinkler head either internally or externally driven, a pop up sprinkler head, an adjustable contour sprinkler head, and the like. The sprinkler head component 14 utilized is to a considerable extent dictated by the lawn position where the sprinkler device 10 of the present invention is to be mounted. The sprinkler device 10 cooperates with an above-ground hose containing a source of water under pressure to provide a part of an ground installed sprinkling system. The system itself would contemplate several sprinkling device 10 installed in various ground positions sufficient to sprinkle the entire lawn area. Basically, the sprinkler devices 10 of the present invention are installed along the periphery of the lawn area to the sprinkled, in the center of the area or both. The peripheral positioning may allow the above-ground hose utilized to be retained in operative position hidden from view, as by bushes, around the periphery of the house or around a fenced periphery.

A central positioning is particularly contemplated when the sprinkler head is an adjustable contour type sprinkler head. In this case, an entire front yard lawn area can be effectively covered by a single sprinkling device 10 once the contour sprinkler head has been adjusted for the central position where the device 10 is installed in the ground. In this case, whenever it becomes necessary to water the lawn area, an above-ground hose is extended to the ground installed sprinkler device 10, which is in the ground. The sprinkler head 14 is manually moved from its stored position into its operative position after which the above-ground hose is connected to the sprinkler head 14 so that the water under pressure will issue forth to water the lawn according to the set pattern.

Figure 1:
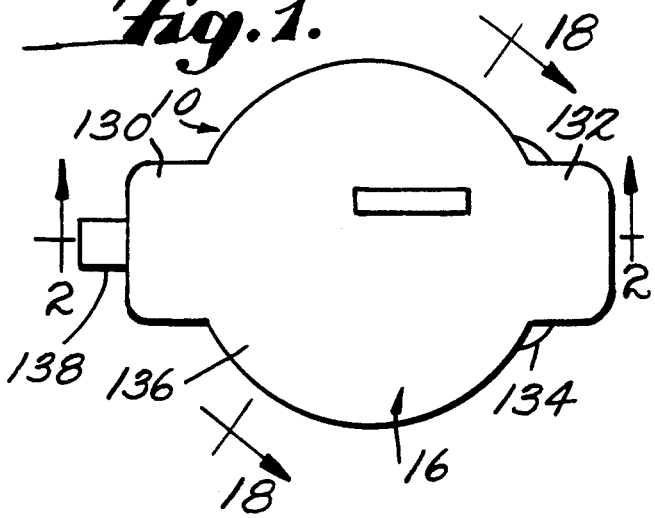
FIG. 1 is a top view of an in-ground sprinkler device embodying the principles of the present invention.
Figure 3:
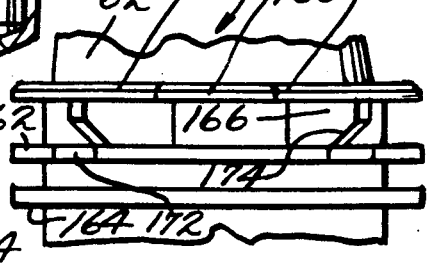
FIG. 3 is an enlarged fragmentary elevational view taken along the line 3—3 of FIG. 2.
Figure 5:
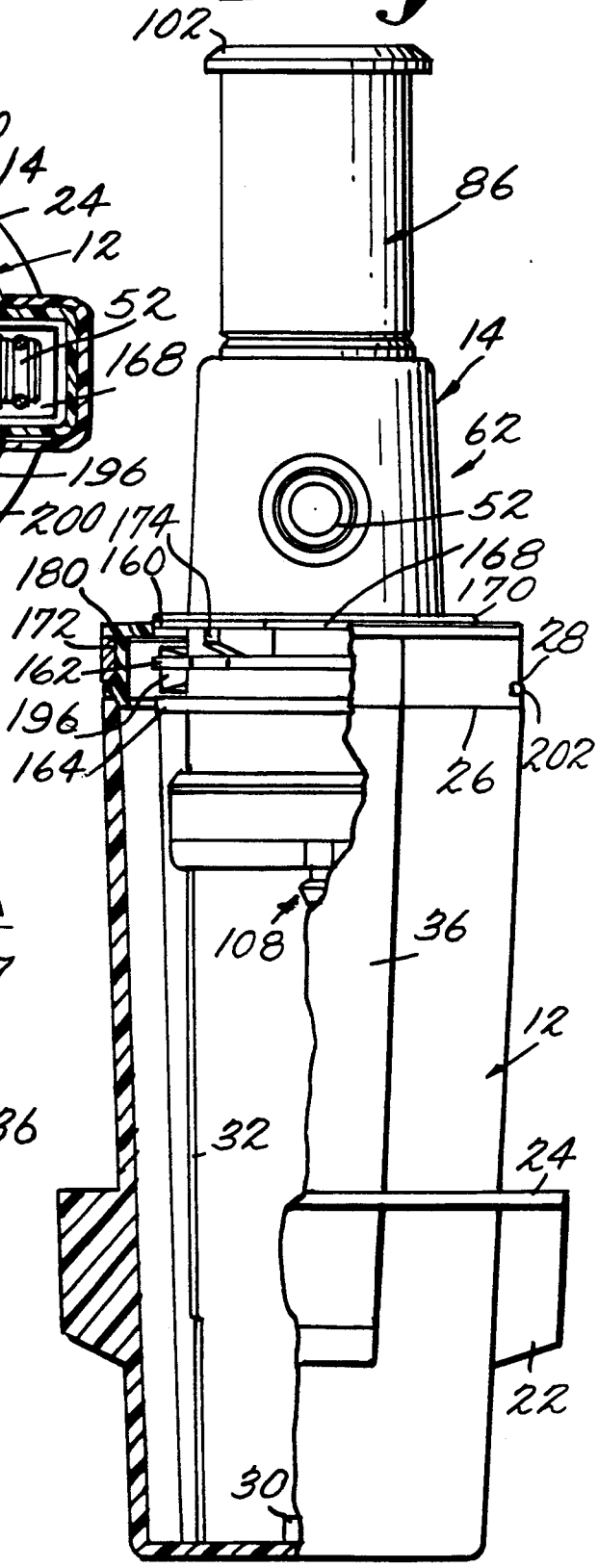
FIG. 5 is a front view of the in-ground sprinkler device showing the container partially in sectional and the sprinkler head component in its operative position.

FIG. 2 and 5 show the presently preferred embodiment of the present invention where the manual movement is rectilinear and the sprinkler head component 14 is an internal drive type. Container 12 can be of any construction as long as it allows for the motion of sprinkler head component 14 from its storage position to its operative position. Preferably, in this embodiment the cooperation between container 12 and sprinkler head component 14 is provided by a mounting assembly, generally indicated at 18, so that sprinkler head component 14 can be manually moved generally rectilinearly between the stored position and the operative position. The preferred mounting assembly 18 shown in the drawings operates between container 12 and the sprinkler head component 14. However, in its broader aspects, the present invention contemplates that the mounting assembly could be between the sprinkler head component 14 and lid 16 with the movement provided being pivotal rather than rectilinear. The mounting assembly 18 shown preferably includes a lock assembly, generally indicated at 20, for retaining the rectilinearly moved sprinkler head component 14 in the operative position. As explained above, it will be understood, however, that in its broader aspects, the invention contemplates other arrangements for retaining the sprinkler head component 14 in its operative position including the adjacent ground or the lid 16. Referring more particularly to the drawings, container 12 has a structure that defines a space having an open top. Sprinkler head component 14 fits within container 12. Lock assembly 20 fits into the open top of container 12. The open top can be covered by lid 16, which is shown in FIG. 1. In FIG. 2, lid 16 is shown in the open position, and sprinkler head component 14 is shown in the stored position. Mounting assembly 18, as seen in FIG. 3, is between sprinkler head component 14 and container 12 and allows the sprinkler head component to manually move in a rectilinear way between its stored position and its operative position. Sprinkler head component 14 is held in the operative position by mounting assembly 18 and lock assembly 20 as seen in FIG. 5.

Figure 4:
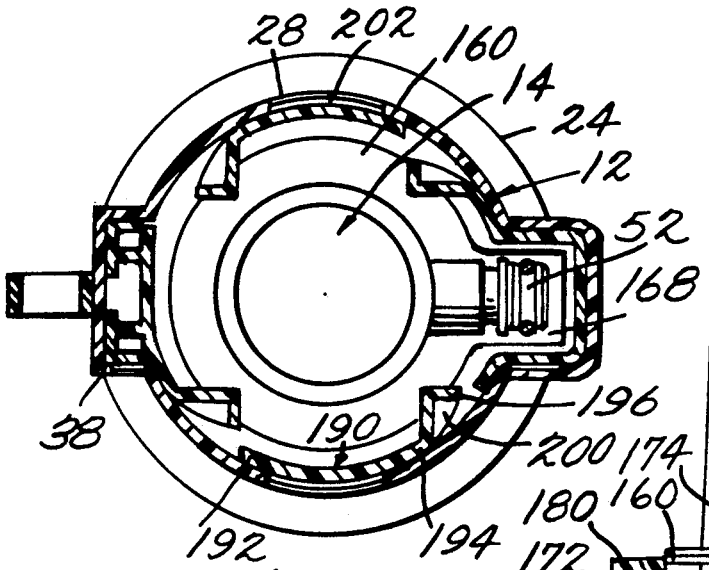
FIG. 4 is a sectional view taken along the line 4—4 of FIG. 2.
Figure 6:
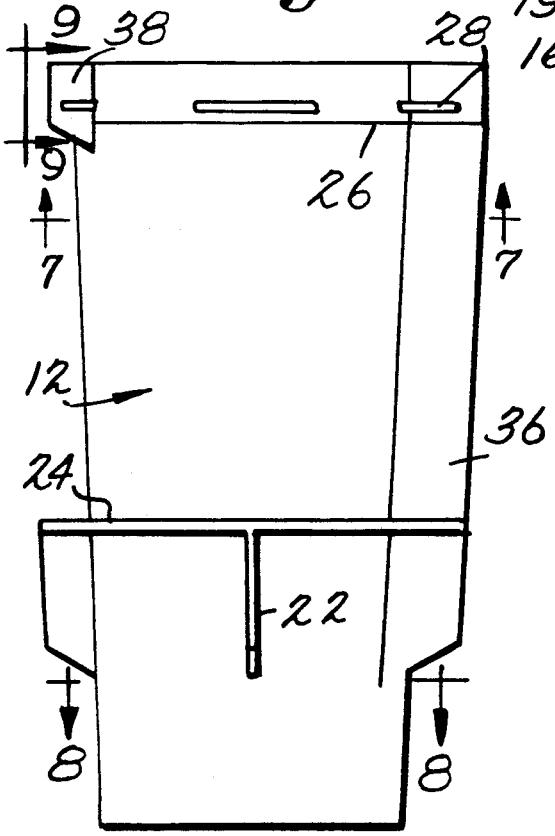
FIG. 6 is a side elevational view of the container structure of the sprinkler device with the sprinkler head component in the stored position.

As shown in FIG. 6, container 12 includes multiple fins 22 projecting from the outside wall. Container outer ring 24 also projects from the outside wall of container 12, which is also seen in FIG. 4. Fins 22 are connected by container outer ring 24, as seen in FIG. 6. Container ridge 26 is near the open top of container 12 as seen in FIGS. 5 and 6.

Figure 9:
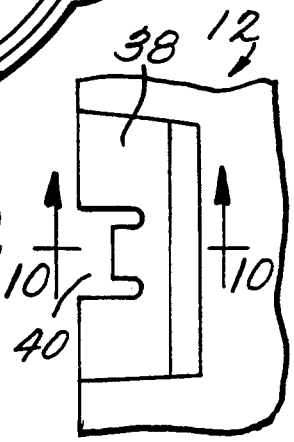
FIG. 9 is a enlarged fragmentary view of the container structure taken along the line 9—9 of FIG. 6.
Figure 10:
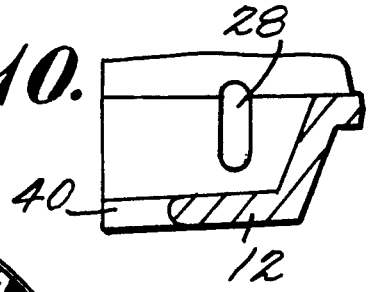
FIG. 10 is a sectional view taken along the line 10—10 of FIG. 9.
Figure 7:
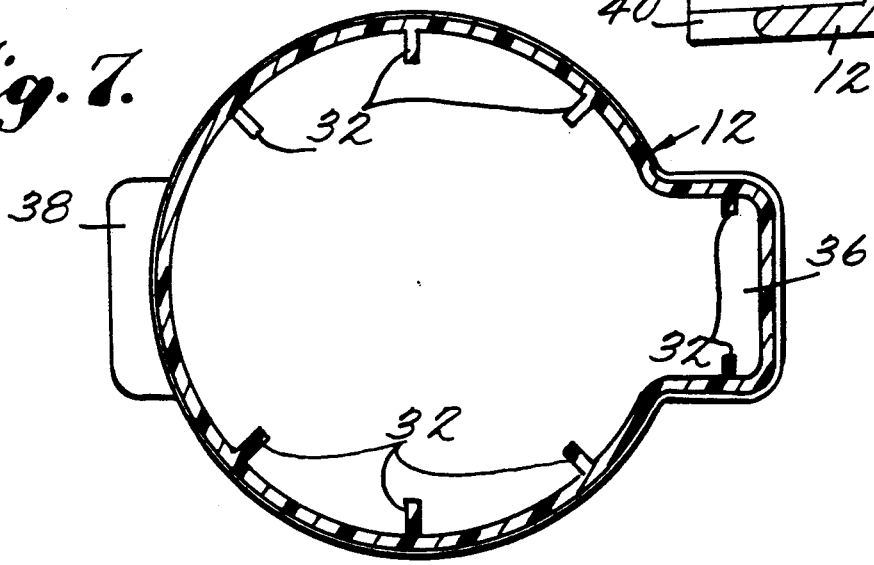
FIG. 7 is a sectional view of the container structure taken along the line 7—7 of FIG. 6.

Container 12 has a container track 36 along one side, also seen in FIG. 7. Container track 36 opens up into the space defined by container 12 and extends down from the open top to a point above the bottom of container 12. Hinge accommodation area 38 is a part of the open top of container 12 on the opposite side from container track 36. Hinge accommodations area 38 extends out from the open top of container 12 (FIGS. 6 and 4). There is a c-shaped cut-out 40 in the hinge accommodation area 38 of container 12 (FIGS. 9 and 10).

Figure 8:
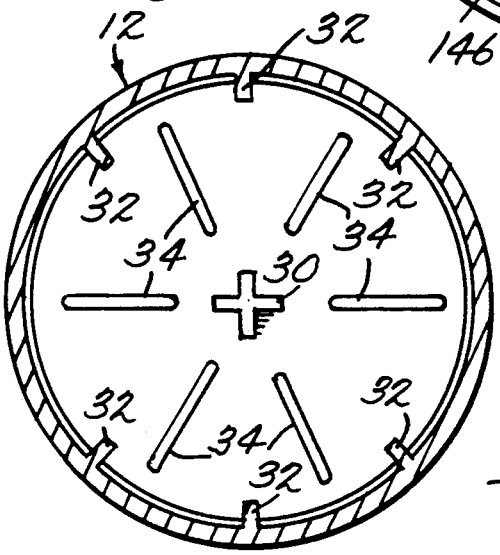
FIG. 8 is a sectional view of the container structure taken along the line 8—8 of FIG. 6.

In FIG. 8, protrusion 30 is positioned inside the container 12 at the bottom center of the container 12 (also seen in FIGS. 2 and 5). Container 12 has distributed along its inside walls multiple splines 32, which extend from the bottom of container 12 to ridge 26. Drain slots 34 are at the bottom of container 12 (FIG. 8). Drain slots 34 extend through the container structure so that a part of the bottom is open. It should be noted, however, that other drain arrangements can be used.

Referring back to FIG. 2, sprinkler head component 14, of the illustrated embodiment, is comprised of a lower casing, generally indicated at 62, a rotational casing, generally indicated at 86, and various internal assemblies (discussed below). Sprinkler head component 14 further includes a hose coupling inlet 52 connected to lower casing 62. Hose coupling inlet 52 provides attachment to the above ground supported portable hoses (not shown). Hose coupling inlet 52 shown is a quick-connect-quick-disconnect type as described in U.S. Pat. No. 4,856,823. However, any type of hose connection can be used. The type of hose coupling inlet would be compatible with the coupling of the above-ground hose used. Water under pressure is introduced into sprinkler head component 14 through hose coupling inlet 52 via above-ground hoses when the two are connected. Water issues forth from sprinkler head component 14 through water outlet 88 and nozzle 106. Sprinkler head component 14 fits into container 12 so that hose coupling inlet 52 is accommodated by container track 36.

As illustrated in FIG. 18, Lower casing 62 has a water tight end cap 54 screwed into place. End cap 54 has a hole 60 in the center thereof. Hole 60 serves as a drain for sprinkler head component 14.

Referring to FIG. 2, Lower casing 62 surrounds internal casing 72. At its bottom edge, internal casing 72 has an L-shaped lip 78. L-shaped lip 78 fits into internal casing track 74 so that when internal casing 72 moves up in a rectilinear way (as will be explained below) L-shaped lip 78 stops the movement of internal casing as it comes into contact with wall 76. Therefore, internal casing 72 will not come out of lower casing 62. Internal casing 72 further has internal casing splines 122 on its inside surface. Internal casing splines 122 extend along the approximate middle one-third of the inside surface. This guides the pop-up movement of internal casing 72 under water pressure to enable a water outlet 88 and nozzle 106 to reach the pop-up operating position.

Figure 14:
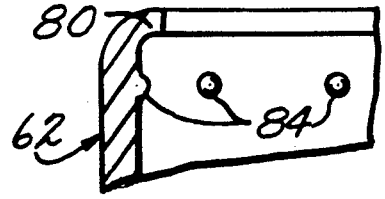
FIG. 14 is a fragmentary sectional view of the sprinkler head component taken along the line 14—14 of FIG. 2.

FIG. 14 shows lower casing upper lip 80. Lower casing upper lip 80 comes into contact with internal casing 72 to stabilize internal casing 72 within lower casing 62. An O-ring 82 is placed around internal casing 72 and seals the connection between lower casing 62 and internal casing 72. Multiple nipples 84 are evenly spaced along the inside wall of lower casing 62 and disposed below lower casing upper lip 80 a distance approximately equal to the diameter of O-ring 82. Nipples 84 support O-ring 82 and keep it in place against the inside wall of lower casing upper lip 80.

Internal casing 72 has rotational casing 86 attached at its top edge so that rotational casing 86 can rotate about its vertical axis while internal casing 72 or outer casing 62 does not. Rotational casing 86 can rotate in a clockwise or counter-clockwise direction. Rotational casing 86 includes a water outlet 88. Further, rotational casing 86 has an open top, which can be closed by removable lid 102. Removable lid 102 shown snaps on and off of rotational casing 86 but it can be any other type of connection.

Internal casing 72 and rotational casing 86 enclose the various internal assemblies that rotate the rotational casing 86. An exemplary embodiment of the structures and assemblies of the internal assemblies shown is disclosed in U.S. Pat. No. 4,892,252, assigned to L. R. Nelson Corporation, the assignee of the present application, the disclosure of which is incorporated by reference into the present application. The internal assemblies include a reversing direction assembly, generally indicated at 90; an internal water motor assembly, generally indicated at 92; a rotary output member, generally indicated at 94; a slip clutch mechanism, generally indicated at 96; a rotational limiting assembly, generally indicated at 98; a reversing mechanism, generally indicated at 100; and an internal gear reduction assembly, generally indicated at 104. Rotational casing 86 is connected to rotary output member 94. Slip clutch mechanism 96 is connected to rotary output member 94 and is normally operable to transmit the rotational movements of rotary output member 94. The rotational movement is created by internal water motor assembly which is driven by water under pressure received by hose coupling inlet. The speed of internal water motor assembly 92 is controlled by internal gear reduction assembly 104. The clockwise or counter-clockwise direction of rotational casing 86 is controlled by reversing direction assembly 90 which is disposed below and connected to internal water motor assembly 92. Mounted within the open top of rotational casing 86 is rotational limiting assembly 98, which is connected to reversing direction assembly 90 by reversing mechanism 100.

Rotational limiting assembly 98 allows the user to preselect any arc between a small angle and 360 degrees to be watered by sprinkler head component 14. When an arc of 360 degrees is preselected sprinkler head component 14 does not need to reverse direction by the reversing direction assembly 90 and will continue in one direction only. Furthermore, the position of the preselected arc can be anywhere within 360 degrees.

Water outlet 88 consists of nozzle 106 so that water will issue out of sprinkler head component in a directed stream. The directed stream of water covers a specified area of lawn as rotational casing 86 rotates about the vertical axis.

Drain hole 60 is a T-shaped hole in end cap 54 of sprinkler head component 14. As seen in FIG. 18, Drain hole 60 is filled with a rubber grommet, generally indicated at 108, so that while water flows through sprinkler head component 14 it only exits through water outlet 88. Referring to FIGS. 19 and 22, rubber grommet 108 is of a shape known in the prior art and has an upper disc 110, a hollow middle extension 112, a bulb 114, and a finger 116. Evenly spaced around upper disc 110 are tabs 118, which have knobs 120 on the underneath side. Upper disc 110 and hollow middle extension 112 are positioned in drain hole 60 so that rubber grommet 108 rests on knobs 120. Bulb 114 and finger 116 are outside end cap 54. The largest cross-sectional area of bulb 114 is bigger than drain hole 60 so that rubber grommet 108 cannot be pulled or pushed into sprinkler head component 14. As seen in FIG. 2 and 18, finger 116 of rubber grommet 108 comes into contact with protrusion 30 when sprinkler head component 14 is in the stored position allowing water to drain from assembly 14.

Figure 11:
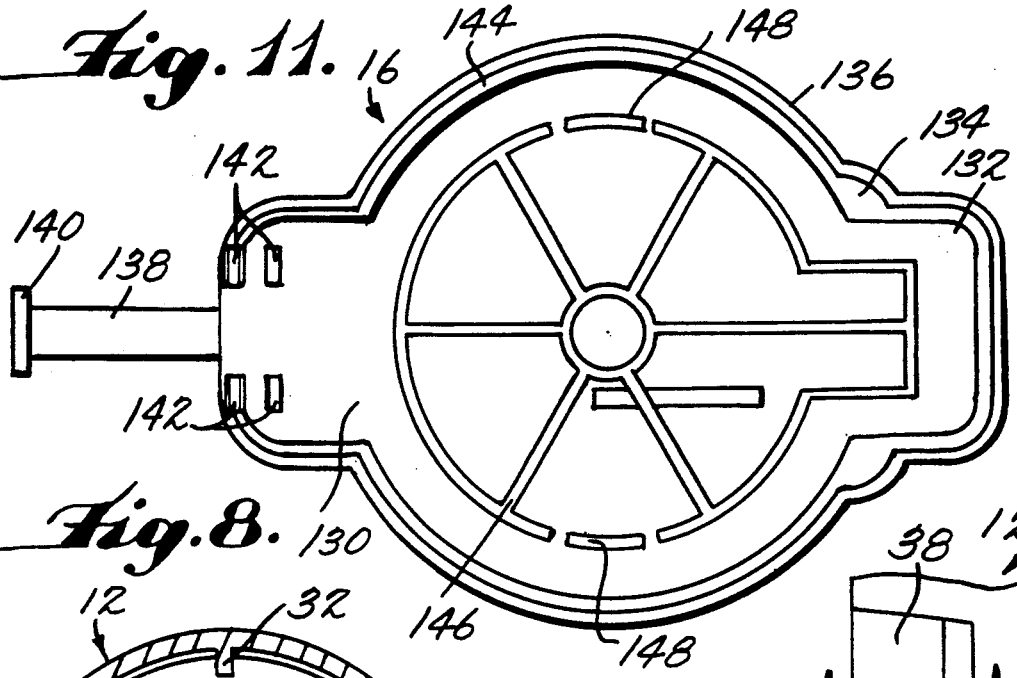
FIG. 11 is a bottom plan view of the lid.

Lid 16, shown in FIGS. 1, 2 and 11, is shaped to cover the open top of container 12. Lid 16 is a generally circular middle portion with two rectangular areas 130 and 132 opposite one another. Rectangular area 130 fits over hinge accommodation area 38, and rectangular area 132 fits over container track 36. Lid 16 is also provided with lifting tabs 134 to aid the user in manually moving lid 16 from the closed to the open positions.

Lid 16 has an overlay 136 that fits atop the lid, as seen in FIG. 2. Overlay 136 secures lid 16 to container by way of connector 138. Connector 138 is T-shaped (FIG. 11) with bar 140, which fits into hinge accommodation area 38.

On the underside of rectangular area 130, there are two C-shaped clasps 142 which allow lid 16 to be pivoted from the closed position to the open position and back again. Lid 16 further has two flanges 144 and 146. Flange 144 surrounds the outer edge of lid 16, and flange 146 is within flange 144, as seen in FIG. 11, so that when lid 16 is in the closed position container 12 is sealed by lid 16. Multiple clips 148 are provided on the underside of lid 16 to secure lid 16 to container 12. Clips 148 are shaped so that lid 16 can snap on and off from container 12 as lid 16 is moved between its open and closed positions.

Figure 15:
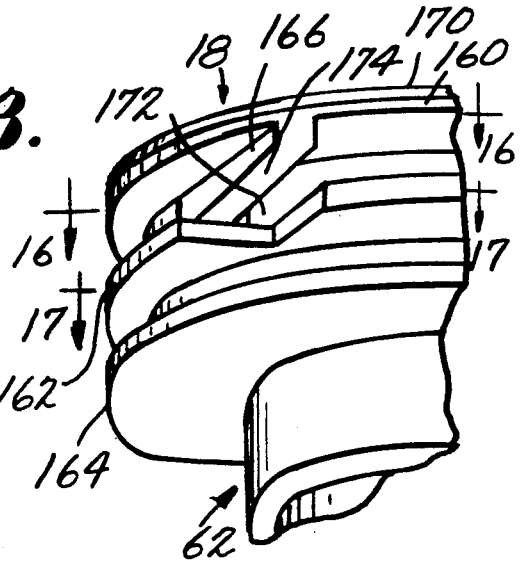
FIG. 15 is a fragmentary elevational view of the sprinkler head component and the mounting assembly.
Figure 13:
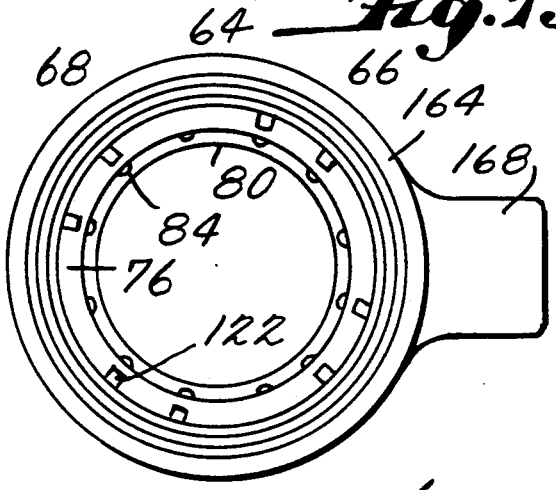
FIG. 13 is a bottom view of the lower casing of the sprinkler head component and the mounting assembly.

Mounting assembly 18 of the preferred embodiment, and shown in FIGS. 3 and 15, is between sprinkler head component 14 and container 12 and is attached to lower casing 62. Mounting assembly 18 allows sprinkler head component 14 to be manually moved between the stored position and the operative position in a rectilinear way and is made up of multiple collars 160, 162, and 164, multiple ribs 166, and a tongue 168, as seen in detail in FIGS. 3, 15, 16, and 17.

Figure 12:
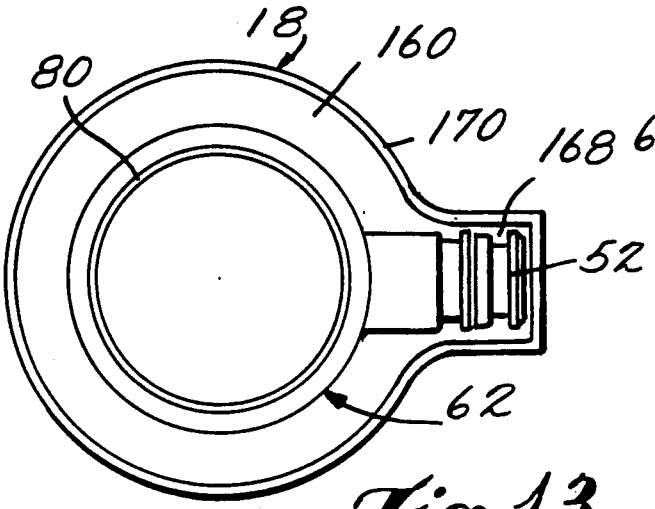
FIG. 12 is a top view of the lower casing of the sprinkler head component and the mounting assembly.

Tongue 168 is a part of first collar 160 and is positioned underneath hose coupling inlet 52. Furthermore, tongue 168 is approximately the area of the cross-section of container track 36 (FIG. 12). First collar 160 and tongue 168 have a beveled upper outside edge 170.

Figure 17:
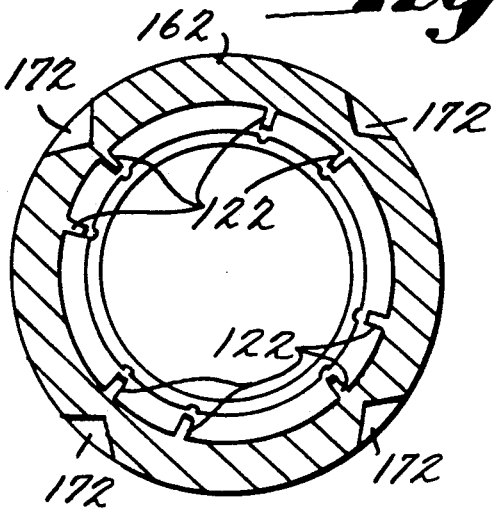
FIG. 17 is a sectional view taken along line 17—17 of FIG. 15.
Figure 16:
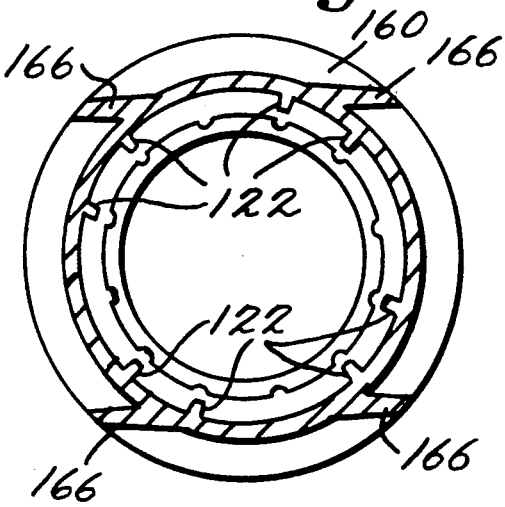
FIG. 16 is a sectional view taken along line 16—16 of FIG. 15.

FIG. 15 is a detailed perspective drawing of multiple collars 160, 162, and 164 and multiple ribs 166 of mounting assembly 18 and shows the relative arrangement of multiple collars 160, 162, and 164 and multiple ribs 166. As seen in FIGS. 15 and 16, multiple ribs 166 are on the under-side of collar 160. As seen in FIGS. 15 and 17, collar 162, which is positioned underneath collar 160 and ribs 166, has multiple notches 172 in its outer edge. Ribs 166 have edges 174 extending from notches 172 to collar 162 at an angle of 45°. Collar 164 is underneath collar 160 and collar 162. In the stored positioned, hose coupling inlet 52 and tongue 168 are accommodated in container track 36 (FIG. 2). When sprinkler head component 14 is manually moved from the stored position (FIG. 5) to the operative position and from the operative position to the stored position, tongue 168 and container track 36 provide a guide for sprinkler head component 14. Splines 32 also help guide sprinkler head component 14 in a rectilinear way.

Lock assembly 20 fits into the open top of the container structure, as shown in FIGS. 2, 4, and 5. The upper ring 180 of the lock assembly 20 allows the open top of the container to still be revealed. Upper ring 180 has hinge assembly, generally indicated at 182, attached to it by one end of hinge support 184. The other end of hinge support 184 is cylindrical rod 186. Hinge support 184 is rectangular shaped and has flanges 188 on its underside extending between cylindrical rod 186 and upper ring 180. Hinge assembly 182 fits into hinge accommodation area 38 so that hinge support 184 and flanges 188 fit into c-shaped cut-out 40. Furthermore, cylindrical rod 186 is positioned outside container 12 (FIG. 2). C-shaped clasps 142 fit onto cylindrical rod 186 so that lid 16 can pivot between its open position and its closed position. When lid 16 is in its closed position, flange 144 surrounds the outer edge of upper ring 180 and flange 146 surrounds the inner edge of upper ring 180 thereby sealing the open top of container 12 revealed by upper ring 180.

Multiple arms, generally indicated at 190, are perpendicularly attached to upper ring 180 at one end 192. Attached ends 192 of arms 190 also have tongues 202. The purpose of tongues 202 is to attach lock assembly 20 to container structure 12. As seen in FIGS. 4 and 5, tongues 202 fit into grooves 28 thereby securing lock assembly 20 to container 12. Snap-tabs 196 are connected to the other end 194 of arms 190, which is unattached. Snap-tabs 196 have upper edges 198 and bottom edges 200 that are angled at 45 degrees (FIG. 2 and 5).

The mounting and lock assemblies 18 and 20 work together so that when a user pulls upward upon the sprinkler head component 14 it snaps into its operative position. To return to the stored position the user pushes down on the sprinkler head component 14 to release the lock assembly 20 from the mount assembly 18. It is also contemplated that the mount assembly 18 is arranged so that the sprinkler head component 14 in its operative position can be rotated until the lock assembly 20 engages the mount assembly 18. In either implementation the user would push the sprinkler head component 14 to release the mount assembly 18 from the lock assembly 20.

Examples of the installation and operation of the sprinkler device 10 will now be explained bearing in mind that a typical installation will be in the yard areas surrounding the house. Typically, the house will provide front and rear knob controlled water outlets to which conventional water hoses can be connected. Commonly assigned U.S. Pat. No. 4,858,827 discloses a programmable device for turning on and turning off the water as well as a lawn mounted stepping valve which allows several in ground installed sprinkler devices 10 to be automatically operated through above-ground portable hoses as a complete system. When an adjustable contour type sprinkler head component 14 is used one installation spot can be selected in the center of the lawn.

When other types of sprinkler head components 14 are used several sprinkler devices 10 can be used in a system. Installation points for several sprinkler devices 10 are preselected so that the yard can be watered in the most effective way with particular emphasis on those locations which allow a permanently hooked up above ground hose to be generally hidden from view, as, for example, along a fence or against the exterior of the house. In this way the watering patterns of the several sprinkler head assemblies can be set to obtain maximum reach and overlapping where desired.

Holes are dug into the ground to install container 12, with the sprinkler head component 14 and mounting assembly 18. The hole is large enough so that the container 12 can be placed into the hole. The open top of container 12 is close to the surface of the ground located at ridge 26. Container 12 must also be placed so that lid 16 can be opened and closed conveniently from an above ground position. Multiple fins 22 and container outer ring 24 secure container 12 in the ground when the hole is filled with dirt.

When in the stored position, sprinkler head component 14 and mounting assembly 18 are in container 12 and lid 16 is atop container 12 so that sprinkler head component 14 and mounting assembly 18 are sealed in container 12. When sprinkler head component 14 is to be placed in the operative position, lid 16 is pivoted from the closed position to the open position. When lid 16 is in the open position, the sprinkler head component 14 can be seen in container 12 in its stored position through the open top of container 12.

The sprinkler head component 14 is manually moved in a rectilinear way from its stored position to its operative position by being pulled up by sprinkler head component 14. The user can simply grasp the top of the sprinkler head component 14, i.e., rotational casing 86, to manually move the sprinkler head component 14. Sprinkler head component 14 is pulled up until it reaches lock assembly 20, and then it is snap-locked by lock assembly 20 into its operative position. Sprinkler head component 14 is snap-locked into position when lock assembly 20 connects with multiple collars 160, 162, and 164 and multiple ribs 166 of mounting assembly 16.

When the beveled edge 170 of first collar 160 and tongue 168 hits lock assembly 20, it meets the angled bottom edges 200 of snap-tabs 196. As sprinkler head component 14 is further pulled into lock assembly 20, beveled edge 170 push against snap-tabs 196 so that unattached ends 194 of arms 190 move in a perpendicular direction to the rectilinear motion of sprinkler head component 14. First collar 160 passes over snap-tabs 196. Snap-tabs 196 proceed so that they fit into notches 172. Bottom edges 200 of snap-tabs 196 hit the third collar 164 as snap-tabs 196 fit into notches 172. Top edges 198 of snap-tabs 196 are positioned against ribs 166. In the operative position, upper ring 180 surrounds first collar 160 and tongue 168. In this way, sprinkler head component 14 is secured into lock assembly 20.

When it is in the operative position, the above-ground portable hose is attached to sprinkler head component 14 at hose coupling inlet 52. The hose coupling inlet 52 shown in the preferred embodiment is of the quick-connect-quick-disconnect variety disclosed in U.S. Pat. No. 4,856,823. It should be noted, however, that any type of coupling can be used for the hose coupling inlet 52. The above-ground portable hose should have a compatible coupling to the hose coupling inlet 52. For the quick-connect-quick-disconnect type provided, U.S. Pat. No. 4,856,823 also discloses the coupling connection required for the above-ground portable hose. While one end of the above-ground portable hose is coupled to hose coupling inlet 52, the other end is connected to a source of water under pressure. When the water supply is turned on, water under pressure is transferred from the water supply to sprinkler head component 14 by way of the above-ground portable hose.

The operation of the sprinkler head component is generally disclosed in U.S. Pat. No. 4,892,252. The pressure differential within sprinkler head component 14 created by the water under pressure entering into the various casings causes sprinkler head component 14 to pop-up. Wall 76 of internal casing track 74 contains the upwardly vertical motion of the rotational casing 86 and the internal casing 72 when L-shaped lip 78 reaches wall 76. With water present, rotational casing 86 will rotate thereby creating the desired water pattern on the lawn. Rotation is created by water driving through internal water motor assembly 92. The direction of the rotation is controlled by the reversing direction assembly 90, which is disposed below the internal water motor assembly 92. The speed of rotation is controlled by the internal reduction gear assembly 104, which reduces the revolutions of the internal water motor assembly down to the desired rotational speed. Rotational casing 86 is rotated by rotary output member 94. Rotary output member 94 and slip clutch mechanism 96 are disposed above internal gear reduction assembly 104 so that if too much force is generated slip clutch mechanism 96 will compensate for the extra force. After water has passed through the rotary output member 94 and slip clutch mechanism 96, water proceeds to water outlet 88 and through nozzle 106. Nozzle 106 allows water to issue out of sprinkler head component 14 in a directed stream as rotational casing 86 rotates about the vertical axis.

Also contained in the upper portion of sprinkler head component 14 is rotational limiting assembly 98 to limit the rotational movement of the rotational casing 86, which creates the selected arc to be watered. Limits positioned between small arcs and 360 degrees can be selected by the user to create the desired watering pattern. Rotational limiting assembly 98 is connected to reversing direction assembly 90 by reversing mechanism 100. When rotational casing 86 reaches a limit position selected in rotational limiting assembly 98, reversing mechanism 100 activates reversing direction assembly 90 so that the direction of rotational casing 86 will change. When no limit is selected, rotational casing 86 will continue in one direction. The user has access to select the various limits by snapping off removable lid 102.

Water does not exit sprinkler head component 14 through drain hole 60 because of rubber grommet 108. When water is introduced into sprinkler head structure, the water pressure pushes down on upper disc 110 and seals drain hole 60. When water is not flowing through sprinkler head component 14, knobs 120 on tabs 118 elevate rubber grommet 108 so that water can escape through hole 60. Water escapes container 12 through drain slots 34.

After the lawn area is adequately watered by way of sprinkler head component 14, the water supply will be turned off and water under pressure will no longer be introduced into sprinkler head component 14. When water under pressure is no longer flowing through the hose or sprinkler head component 14, rotation casing 86 and internal casing 72 fall-down or can be pushed down from their popped-up position. Sprinkler head component 14 can remain in its operative position with the above-ground portable hose still attached and ready for the next time the area needs to be watered, or the sprinkler head component 14 can be returned to its stored position within container 12. If sprinkler head component is to return to its stored position, the hose must be detached from hose coupling inlet 52 so that the hose and sprinkler head component 14 are free of one another.

When the hose is no longer attached to sprinkler head component 14, sprinkler head component 14 can be manually returned to the its stored position in the container. Lock assembly 20 is released from mounting assembly 18 when sprinkler head component 14 is pushed down, which also ensures that rotational casing 86 and internal casing 72 is returned to its original position. Top edges 198 of snap-tabs 196 are moved along edges 174 of ribs 166 so that sprinkler head component will move. Snap-tabs 196 and unattached ends 194 of arms 190 will be fully depressed when first collar 160 reaches snap-tabs 196. Lower edges 200 of snap-tabs 196 then will move against the beveled edge 170 of collar 160 and tongue 168 until they move back to their inert position. Sprinkler head component 14 is therefore able to move to its storage position within container 12.

As sprinkler head component 14 is pushed into its stored position, finger 116 touches protrusion 30 and pushes up rubber grommet 108. As rubber grommet 108 moves, it opens drain hole 60 to ensure any seal by rubber grommet 108 is broken. Accordingly, any water still contained in sprinkler head component 14 is drained. Water again escapes container 12 through drain slots 34.

Once sprinkler head component 14 is in its stored position, lid 16 is free to move again. Lid 16 is therefore moved from its open position to its closed position so that the open top of container 12 can be sealed. Sprinkler head component 14, mounting assembly 18, and container 12 remain in the ground for storage and are adjusted ready for use the next time the area needs to be watered.

It should be noted that sprinkler head component 14 can be completely removed from container 12 to make any necessary repairs or for winter storage. In order for sprinkler head component 14 to be removed from container 12, mounting assembly 18 is rotated relative to the lock assembly 20 so that unattached ends 194 of arms 190 will be fully depressed by collar 162 and come out of notches 172. The sprinkler head component can be manually moved in a rectilinear way from its stored position completely out of container 12.

It should also be noted that as watering needs change, or for other reasons, sprinkler device 10 can be dug up from its location in the ground and installed elsewhere in the yard.

After reading and understanding the foregoing description of an inventive sprinkler device for in-ground installation, in conjunction with the drawings, it will be appreciated that distinct advantages of the subject matter are obtained.

In describing the invention, reference has been made to a preferred embodiment and illustrative advantages of the invention. Those skilled in the art, however, and familiar with the instant disclosure of the subject invention, may recognize additions, deletion, modifications, substitutions and other changes which will fall within the purview of the subject invention and claims.

What is claimed is:

1. A lawn sprinkler device for installation within the ground for discharging water in a desired pattern on a lawn area of the ground when manually connected by a user with an above-ground hose as a source of water under pressure, said device comprising:

a manually operative combination of container, sprinkler head and lid components, said container and lid components being manually movable between (1) a closed position wherein a substantially closed volume is defined within said container and lid components and (2) an open position wherein access to said closed volume is available through an open top of said container, said container and lid components being adapted to be mounted within the ground in the lawn area to be sprinkled so that (1) when said container and lid components are in said closed position said closed volume extends downwardly from the level of the lawn area, and (2) when said container and lid components are in said open position access to said closed volume is available generally at the level of said lawn area, said sprinkler head component including (1) a hose coupling inlet for manual connection by a user with an above-ground hose containing a supply of water under pressure and (2) an outlet structure for discharging water under pressure in a desired pattern on the lawn area to be sprinkled when an above-ground hose containing a source of water under pressure is manually connected with said hose coupling inlet, said sprinkler head component being mounted with respect to said container and lid components for manual movement between (1) a storage position wherein said sprinkler head component is disposed within said closed volume with said container and lid components disposed in said closed position and (2) an operative position wherein said sprinkler head component is in accessed elevated relation to said closed volume with said container and lid components in said open position enabling said hose coupling inlet to be manually connected by a user with an above ground hose containing a source of water under pressure so that water will be discharged from said outlet structure in the desired pattern on the lawn area.

2. A sprinkler device as defined in claim 1 wherein said manual movement of said sprinkler head component from said stored position to said operative position and from said operative position to said stored position is rectilinear.

3. A sprinkler device as defined in claim 2 wherein said sprinkler head component is snap-locked into said operative position by a mount assembly and a lock assembly, said mount assembly being between said sprinkler head component and said container.

4. A sprinkler device as defined in claim 3 wherein said lock assembly is attached to said container component at the open top thereof and wherein said lock assembly connects with said mount assembly when said sprinkler head component is snap-locked into said operative position and releases said mount assembly when said sprinkler head component is manually moved from said operative position to said storage position.

5. A sprinkler device as defined in claim 4 wherein said container component further has multiple grooves below said open top and said lock assembly further has multiple tongues so that said tongues fit into said grooves securely attaching said lock assembly to said container component.

6. A sprinkler device as defined in claim 5 wherein said lock assembly further comprises:

an upper ring having a hole so that said container component has said open top when said lock assembly is connected to said container component;

multiple arms below said upper ring perpendicularly attached to said upper ring at one end thereof, each of said attached ends having one of said tongues and unattached to said upper ring at another end thereof, said unattached end having a tab;

said mount assembly further including multiple collars including;

a first collar having multiple ribs on the underside thereof and the top outer edge of said first collar being beveled; and a said second collar having multiple notches in an outer edge thereof, said notches being aligned with said ribs and shaped to accommodate said tabs so that when said sprinkler head component is in said operative position said upper ring surrounds said first collar said ribs are above and adjacent said tabs, said tabs fitting into said notches and a third collar below and adjacent to said tabs.

7. A sprinkler device as defined in claim 6 wherein said lock assembly further comprising a hinge assembly, said hinge assembly attached to said upper ring at one end thereof and a cylindrical rod at another end thereof; and said lid component further having multiple clasps that fit onto said cylindrical rod of said hinge assembly so that said lid component is thereby attached to said container component and can be manually moved between said closed and open positions.

8. A sprinkler device is defined in claim 7 wherein said lid component further comprises:

multiple clips for securing so that said lid component is secured to said container component when said lid component is in said closed position; and a lifting tab to manually move said lid component between said closed and open positions.

9. A sprinkler device as defined in claim 2 wherein said sprinkler head component can be manually removed from said container components.

10. A sprinkler device as defined in claims 1 or 2, wherein said sprinkler head component includes an internal drive for establishing rotational movement.

11. A sprinkler device as defined in claim 10 wherein said sprinkler head component includes a rotary member in an upper portion thereof mounted for rotational movement about a vertical axis, said outlet structure being disposed in said rotary member; and said outlet structure including a nozzle for directing water under pressure communicated therewith into an upwardly and outwardly directed stream.

12. A sprinkler device as defined in claim 11 wherein said sprinkler head component is operable by water under pressure for effecting movement of the rotary member of said sprinkler head component about said vertical axis.

13. A sprinkler device as defined in claim 12 wherein said sprinkler head component includes an internal water motor assembly driven by water under pressure received in said hose coupling inlet and an internal reduction gear assembly drivingly connecting said water motor assembly with the rotary member of said sprinkler head component.

14. A sprinkler device as defined in claim 13 wherein said sprinkler head component includes an assembly means for limiting the rotational movement of the rotary member of said sprinkler head component between preselected arc limits of rotational movement and an assembly means for reversing the direction of rotational movement of said water motor assembly so that the rotary member of said sprinkler head component moves in repetitious cycles between said limits wherein each cycle includes a movement in one direction from a first limit to a second limit and a movement in an opposite direction from said second limit to said first limit.

15. A sprinkler device as defined in claim 14 wherein said sprinkler head component includes means for selectively enabling the rotary member of said sprinkler head component to (1) move through said repetitious cycles or (2) move in one direction through repetitious 360° rotational cycles.

16. A sprinkler device as defined in claim 15 wherein said sprinkler head component includes assembly means for selectively adjusting (1) the arcuate extent between the first and second limits and (2) the positions within the 360° extent of rotational movement of the rotary member of said sprinkler head component where the first and second limits occur.

17. A sprinkler device as defined in claim 2 wherein said container component further comprises:

a track wherein said hose coupling inlet is accommodated; and said mount assembly further including a tongue to fit into said track so that said sprinkler head component manual movement is rectilinear.

18. A sprinkler device as defined in claim 1 wherein the hose coupling inlet is a quick-connect-quick-disconnect fitting disposed in a position to cooperate with a cooperating quick-connect-quick-disconnect fitting of said hose from a position above ground.

19. A sprinkler device as defined in claim 1, wherein said sprinkler head component further includes a drain, said drain filled by a rubber grommet so that when water under pressure flows through said sprinkler head component said rubber grommet occupies said drain thereby water under pressure issues forth from said outlet structure and when water under pressure no longer flows through said sprinkler head component said rubber grommet allows water to exit from said sprinkler head component through said drain.

20. A sprinkler device as defined in claim 19, wherein said container component further comprises a drain so that water does not remain in said container component.

* * * * *